US011298705B2

(12) United States Patent
Doppstadt

(10) Patent No.: US 11,298,705 B2
(45) Date of Patent: Apr. 12, 2022

(54) CRUSHING APPARATUS FOR CRUSHING MATERTAL TO BE CRUSHED

(71) Applicant: Doppstadt Familienholding GmbH, Velbert (DE)

(72) Inventor: Ferdinand Doppstadt, Velbert (DE)

(73) Assignee: Doppstadt Familienholding GmbH, Velbert (DE)

( * ) Notice: Subject to any disclaimer, the term of this patent is extended or adjusted under 35 U.S.C. 154(b) by 206 days.

(21) Appl. No.: 16/483,108

(22) PCT Filed: Jan. 19, 2018

(86) PCT No.: PCT/EP2018/000025
§ 371 (c)(1),
(2) Date: Aug. 2, 2019

(87) PCT Pub. No.: WO2018/153541
PCT Pub. Date: Aug. 30, 2018

(65) Prior Publication Data

US 2020/0023375 A1 Jan. 23, 2020

(30) Foreign Application Priority Data

Feb. 27, 2017 (DE) ..... 10 2017 001 813.8

(51) Int. Cl.
*B02C 18/24* (2006.01)
*B02C 18/00* (2006.01)
(Continued)

(52) U.S. Cl.
CPC ..... *B02C 18/24* (2013.01); *B02C 18/0084* (2013.01); *B02C 18/145* (2013.01); *B02C 2018/164* (2013.01)

(58) Field of Classification Search
CPC ... B02C 18/24; B02C 18/0084; B02C 18/145; B02C 18/164; B02C 18/06; B02C 18/16; B02C 4/42
See application file for complete search history.

(56) References Cited

U.S. PATENT DOCUMENTS 3,604,545 A * 9/1971 Bourgeois ..... F16C 27/066 192/98
6,285,525 B1 * 9/2001 McCutcheon ..... B32B 27/06 360/98.08
(Continued)

FOREIGN PATENT DOCUMENTS

DE 8604024 U1 * 3/1986 ..... B02C 4/42
DE 8604024 U1 3/1986
(Continued)

OTHER PUBLICATIONS

English translate (DE8604024U1), retrieved date Apr. 13, 2021.*
(Continued)

*Primary Examiner* — Jessica Cahill
*Assistant Examiner* — Mohammed S. Alawadi
(74) *Attorney, Agent, or Firm* — Jason H. Vick; Sheridan Ross, PC

(57) ABSTRACT

The invention relates to a crushing apparatus (1) for crushing material to be crushed, especially for use in the field of recycling and waste processing, with at least one crushing roller (2) that can rotate about an axis of rotation (3), at least one drive device (4) for driving the crushing roller (2), and a frame (5) for supporting and mounting the crushing roller (2) and the drive device (4). According to the invention, it is provided that the crushing roller (2) and the drive device (4) form a common assembly connected to at least one damping device (16), which is frictionally and/or elastically mounted in or on the frame (5).

19 Claims, 11 Drawing Sheets

Figure 1:
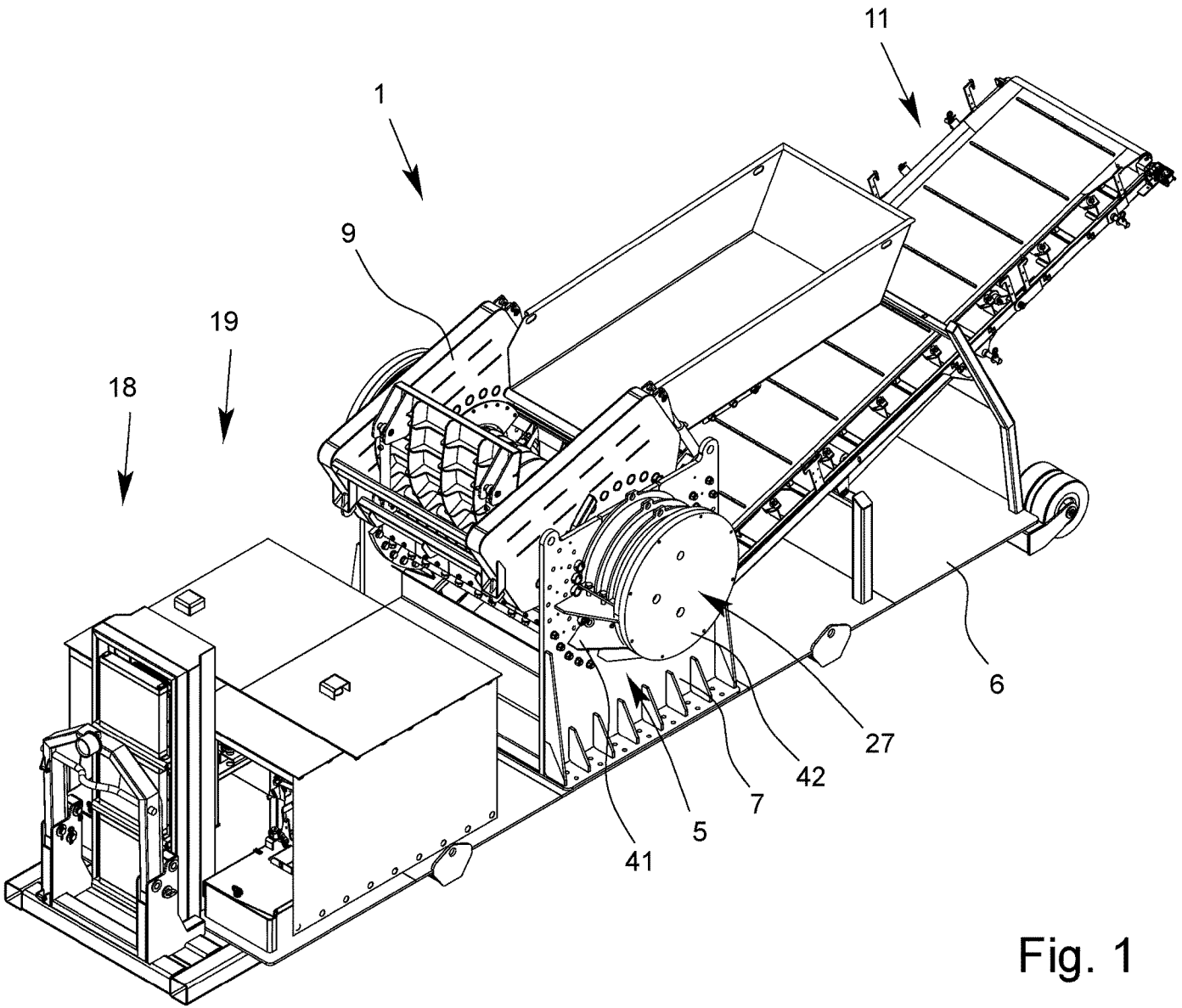

(51) Int. Cl.

| | |
|---|---|
| ***B02C 18/14*** | (2006.01) |
| ***B02C 18/16*** | (2006.01) |
| ***B02C 18/06*** | (2006.01) |

(56) References Cited

U.S. PATENT DOCUMENTS

| | | | | |
|---|---|---|---|---|
| 2007/0164139 | A1 | 7/2007 | Lipowski et al. | |
| 2015/0060583 | A1* | 3/2015 | Boehlefeld | B02C 18/24 241/167 |
| 2016/0121338 | A1* | 5/2016 | Jonkka | B02C 1/02 241/30 |

FOREIGN PATENT DOCUMENTS

| | | | | |
|---|---|---|---|---|
| DE | 4110643 | A1 * | 10/1992 | B02C 4/42 |
| DE | 4110643 | A1 | 10/1992 | |
| DE | 102009000442 | B4 * | 4/2011 | B02C 15/02 |
| DE | 102011052633 | B3 * | 9/2012 | B02C 4/02 |
| DE | 102011052633 | B3 | 9/2012 | |
| DE | 102013219629 | A1 | 4/2015 | |
| EP | 1803501 | A1 | 7/2007 | |
| EP | 2545994 | A1 | 1/2013 | |
| KR | 200241966 | Y1 * | 9/2001 | |

OTHER PUBLICATIONS

English translate (DE102011052633B3), retrieved date Apr. 14, 2021.*

English translate (DE4110643A1), retrieved date Apr. 14, 2021.*

English translate (DE102009000442B4), retrieved date Apr. 14, 2021.*

English translate (KR200241966Y1 ), retrieved date Apr. 14, 2021.*

English Translation of International Preliminary Report on Patentability for International Application No. PCT/EP2018/000025, dated Aug. 29, 2019.

* cited by examiner

CRUSHING APPARATUS FOR CRUSHING MATERTAL TO BE CRUSHED

CROSS REFERENCE TO RELATED APPLICATIONS

This application is a national stage application under 35 U.S.C. 371 of PCT Application No. PCT/EP2018/000025 having an international filing date of 19 Jan. 2018, which designated the United States, which PCT application claimed the benefit of German Application No. 10 2017 001 813.8, filed 27 Feb. 2017, each of which are incorporated herein by reference in their entirety.

The invention relates to a crushing apparatus for crushing material to be crushed, in particular for use in the field of recycling and waste processing, with at least one crushing roller that can rotate about an axis of rotation, one drive device for driving the crushing roller, and a frame for supporting and mounting the crushing roller and the drive device.

Crushing devices of the mentioned kind, which are used in particular in the heavy load area during waste recycling and waste processing, are already known in practice. They are usually operated with rotary speeds in the range of up to 400 rpm. During the operation, material to be crushed, also known as substrate, is fed to the particular crushing apparatus. Depending on the purpose of its use and the feedstock, it may happen that the material to be crushed cannot easily be crushed into the desired form. This may result in spontaneous overloading and extreme load peaks during the operation. In this way, the crushing tools usually provided on the crushing roller may be heavily loaded and as a result become damaged or even destroyed. Moreover, load peaks of the mentioned kind also result in non-calculable overload peaks in the gearing usually associated with the drive device, which may result in gearing damage or even gearing destruction. Furthermore, overload peaks also contribute significantly to an increased noise level for the working and operating noises, which impacts not only the operating crew working in the area of the crushing apparatus, but also nearby residents in whose vicinity the crushing apparatus is mounted.

Another drawback of the known crushing apparatus is that their size is relatively large. Not least of all, this is due to the fact that the configuration of the drive device with motor and gearing results in a relatively large width, which ultimately means that the known crushing apparatus can only be transported as a heavy load.

The problem which the invention proposes to solve is to avoid the aforementioned drawbacks.

For the solution of the aforementioned problem, in a crushing apparatus of the kind mentioned above it is now provided according to the invention that the crushing roller and the drive device form a common assembly connected to a damping device, which is frictionally and/or elastically mounted in the frame. Unlike in the prior art, due to the damping device which is frictionally and/or elastically mounted in the frame it is possible for the crushing roller together with the drive device to perform a deflection movement, preferably in the range of several millimeters, in event of an overload, which prevents or in any case significantly decreases the overload peaks occurring on the crushing roller and/or the crushing tools of the crushing roller. The possible deflection movement of the crushing roller and the drive device, which are combined to form a common assembly, ultimately means that in event of an overload a relative movement is possible between the "problematic" material to be crushed that is causing the overload and the crushing tools, so that the large overload peaks that occur in the prior art with a rigid mounting are avoided in the invention. Not only does this mean that it is possible to prevent damage or even destruction of the drive device, but the entire layout can also be operated much more quietly, so that the noise impact on the operating personnel can be reduced. The damping, i.e. the possible deflection movement of the assembly relative to the frame, is made possible by the invention on the one hand by the damping device being realized by a friction locking connection. An alternative possibility is the elastic mounting of the damping device in the frame. The third possibility is to implement, first, the friction locking and, second, the elastic mounting on the other hand in combination.

In order to accomplish the most comprehensive damping or decoupling of the subassembly from the frame, it is provided according to the invention that the damping device is designed such that a movement of the crushing roller is possible in the axial direction and/or in the radial direction of the axis of rotation of the crushing roller. Ultimately, the mentioned design can ensure that the crushing roller is able to deflect in all three directions as needed, i.e. the damping is ultimately possible in all directions.

In the configuration according to the invention, it is basically possible for the drive device to be active either on only one side of the crushing roller or on both sides of the crushing roller. In the event that a drive device is provided at the end face on both sides of the crushing roller, the two drive devices are of course synchronized by a corresponding control device. Regardless of whether one or two drive devices are provided, it is provided in the invention that the crushing roller is mounted damped on both sides. This configuration according to the invention ultimately ensures that the crushing roller can easily perform necessary deflection movements to avoid overload peaks and to protect the crushing tools.

In one particularly preferred embodiment of the invention, the damping device comprises a flexible damping means, in particular one shaped as a circular ring, which is arranged in a corresponding seat of the frame frictionally and/or positive-locking. Preferable in each case is a torsionally rigid arrangement of the damping means in the seat. Ultimately, the damping means can be configured in the manner of a wheel tire, which is then arranged in a seat on the frame corresponding to the external shape of the wheel tire. The elasticity or rigidity of the damping means will then result from an appropriate choice of material, comprising in any case a flexible plastic, synthetic rubber, natural rubber, or mixtures thereof.

In order to achieve a large frictional force between the damping means and the seat, in one preferred embodiment of the invention it is provided that the damping means comprises on its (peripheral) outer side and/or the seat comprises on its inner side facing toward the damping means a surface structure and/or a coating with an increased coefficient of friction. By an increased coefficient of friction is meant a coefficient of friction greater than 0.4. Especially preferred are material pairings of the damping means and the seat in which coefficients of friction greater than 0.5 and particularly greater than 0.6 result.

Alternatively to the realization of a torsionally rigid frictional locking between the damping means and the seat, it is also fundamentally possible to realize a positive connection between these two components, but in this case at least the torsionally rigid connection of the damping means and the seat must be assured. The elasticity is preferably achieved through the choice of the material of the damping means. In order to realize the positive connection of the damping means to the seat, there are provided protrusions and/or indentations in particular on the (peripheral) outer side of the damping means, while relevant and/or corresponding indentations and/or protrusions are provided on the inner side of the seat facing toward the damping means. The positive fit is then accomplished by the intermeshing of the protrusions and the indentations, while a damping is achieved through the elasticity of the damping means.

It is of special benefit in connection with the present invention that the rigidity of the damping means is adjustable automatically, but also manually adjustable as needed. In particular, the invention is characterized in that the adjustability can also be set during the operation of the crushing roller. In this way, the damping can be set as needed according to the application. Thus, if a material is being crushed that has a tendency to cause fewer overload peaks, a relatively stiff damping can be set. On the other hand, for a crushing material with a greater tendency to lead to overload peaks, a softer damping between the damping means and the seat will be set.

In one particularly preferred embodiment of the aforementioned adjustability, it is provided that the damping means is designed as a hollow body which can be filled with a medium. The medium can be pressurized air, for example, or also a liquid, such as water or oil, in which case the liquid is then pressurized with an appropriate pressure and supplied to the cavity of the hollow body. Depending on the pressure of the medium, the rigidity of the damping means can then be adjusted.

In order to ensure a proper operation of the crushing apparatus according to the invention, in another preferred embodiment of the invention there is provided a measuring device for measuring the pressure of the medium. The measuring device is then preferably coupled to a control device, which appropriately processes the respective measurement signal. For example, if the pressure is too low, this may result in a slippage or an improper movement of the crushing roller during the operation. On the other hand, if the pressure of the medium is too high, very large overload peaks may occur, which are to be avoided according to the invention. Ultimately, then, a correction as needed will be performed via the control device, depending on the measured pressure value.

The mentioned control device can moreover be coupled to a signal device by which a signal is emitted optically and/or acoustically when a pressure value of the medium lying outside the norm is detected.

Furthermore, the control device may be coupled to a disconnection device of the drive device. In this case, the drive device can be switched off directly or a device connected upstream from the drive device for the power supply of the drive device can be switched off. The disconnection device thus serves either for the direct or indirect switch-off of the drive device.

Furthermore, it may be provided that the control device is coupled to a filling device for the filling or emptying of the hollow body. As needed, the pressure of the medium can be increased or decreased via the filling device.

A so-called connection means serves for the connection of the damping means to the drive device. Both the drive device and the damping means are firmly attached to the connection means. In the design implementation of this notion of the invention, the connection means first comprises a flange plate for the torsionally rigid connection to the drive device. The drive device is ultimately flanged onto the flange plate and firmly joined to it. Second, the connection means comprises a hollow cylindrical fastening area firmly connected to the flange plate which is connected on the inside to the flange plate and on the outside to the damping means.

Although it is basically advantageous to allow the largest possible deflection movements in order to achieve a good damping effect by the damping device, the deflection movement should still be limited to a maximum value during the damping. The reason for this is that usually a plurality of crushing tools are provided on the crushing roller. These ultimately interact with a corresponding counter-comb, which is attached directly or indirectly to the frame. The tools are knives or teeth provided on the outer shell of the crushing roller, protruding beyond the roller shell. The crushing tools on the crushing roller correspond to the counter-comb, having teeth with corresponding gaps. The crushing tools are led through the gaps on the counter-comb during the rotation of the crushing roller. Usually there is a gap and/or play of less than 1 cm, generally in the range of 3 mm to 6 mm, between the teeth and/or protrusions of the counter-comb and the crushing tools. Accordingly, overly large deflection movements of the subassembly with the crushing roller mean that the crushing tools collide with the counter-comb, which may result in a long-lasting disturbance of the crushing process or even a damaging of the crushing apparatus. In this context, it is preferably provided according to the invention that at least one end stop means is provided for limiting the axial and/or radial deflection movement of the crushing roller. It will be understood that the end stop means is configured such that, although a movement of the subassembly is possible on account of the damping device, this movement corresponds at most to the gap size between the crushing tools and the counter-comb. Preferably, the end stop means is configured such that the stopping function occurs at latest when the gap size and/or the distance between the crushing tools and the counter-comb has decreased to at most 1 mm during rotation of the roller.

In one preferred embodiment of the invention, the end stop means comprises a cylindrical or rod-shaped end stop element and a corresponding hollow or hollow cylindrical section for the engagement of the end stop element. It should be pointed out that the cylindrical stop can also basically be a hollow cylinder. The interaction of the end stop section with the hollow or hollow cylindrical section provides an end stop means acting both in the axial direction, namely, when the end stop element bears by its front end face against the inner end face of the hollow or hollow cylindrical section, and an end stop in the radial direction, namely, when the outside of the end stop element bears against the inside of the hollow or hollow cylindrical section.

In one design of the aforementioned end stop means, it is provided in one particular embodiment that an outer supporting plate is provided for the closure of the seat on the outside, on which the end stop section, particularly a cylindrical one, is provided, while the end stop element is secured to the flange plate of the connection means.

However, of course, it is also basically possible to realize the mentioned arrangement the other way round, in which case the end stop section is provided on the flange plate, while the hollow cylindrical or hollow end stop element is provided on the supporting plate.

Alternatively or additionally to the aforementioned end stop means, an end stop protrusion may also be provided to limit the movement of the crushing roller in the axial direction, being provided ultimately on a bearing wall of the frame and pointing in the direction of the outer end face of the crushing roller, in order to interact with the end face of the crushing roller as needed.

In another preferred embodiment of the invention, it is provided that at least one fixation device is connected to the connection means, the fastening area and/or the flange plate, especially in positive-locking and/or force-locking, preferably torsionally rigid, manner, for the securing of the damping device and/or the damping means and/or the connection means. Consequently, the fixation device can connect the damping device, the damping means and/or the connection means to the frame at least indirectly and in torsionally rigid manner and/or to the seat, preferably directly. The fixation device may be configured as a torque bracket.

The fixation device may comprise a fastening section and an operating section, whereby in particular an at least substantially angled cross-section shape of the fixation device may result. The fastening section can be connected to the connection means, the fastening area and/or the flange plate. Furthermore, the operating section may interact at least indirectly with the bearing wall of the seat. Additionally, the operating section can interact with and/or be connected to, preferably firmly, the seat and/or a supporting device arranged on the seat and firmly connected to the frame.

A torque bracket generally refers to a machine element, and is ultimately a self-standing structural part. The task of the torque bracket and/or the fixation device is to absorb the differential torque—in this case, the differential torque between the damping means and the frame. The damping means is preferably situated torsionally rigidly in the seat of the frame. The torque bracket or the fixation device in this case makes sure that the torsionally rigid connection can always be ensured—even under high stress on the damping means.

For the mounting of the operating section of the fixation device, openings for engaging with screws of the fixation device can be provided on the seat, the bearing wall, and/or the supporting device, where a plurality of openings can enable different engagement positions of the fixation device, especially of the operating section. In addition, a connecting means can be provided for the mounting of the operating section of the fixation device, wherein the connecting means may be connected to the operating section and interact with the supporting device, the seat, and/or the bearing wall. Moreover, the connecting means can be connected to the supporting device, the seat and/or the bearing wall especially in a positive-locking and/or force-locking, particularly torsionally rigid, manner.

For the mounting of the fixation device, the angle with respect to the cutting action—roller tooth and/or crushing tools relative to housing tooth and/or counter-comb tooth—is of great significance to the process engineering. The vertex of the angle specifications in the context of the present invention refers to the axis of rotation of the crushing roller. Especially preferred, the fixation device, in particular the operating section of the fixation device, is situated transversely and/or at least substantially at a 90° angle to the cutting action. Furthermore, starting from this position, an adjustment of the fixation device by +/−45° can preferably be provided. Basically, it is even conceivable to arrange the fixation device, especially the operating section, at any given angle to the cutting action, wherein the fastening section of the fixation device is constantly connected to the flange plate, the fastening area, and/or the connection means.

Of course, it is even possible to provide a plurality of fixation devices, preferably two. The fixation devices may be situated opposite each other and/or form an angle between 80° and 180°, preferably between 100° and 180°, further preferably between 140° and 180°, further preferably between 160° and 180°, with each other. Starting from a subtended angle of 180°, the mounting of the second fixation device may even be varied by +/−100°. For the adjustment of the fixation device(s), a plurality of openings, preferably for the connecting means, can be provided on the supporting device, the bearing wall, and/or the seat.

Preferably, a second fixation device is provided, which is situated opposite the first fixation device in particular, and connected with the supporting device or a second supporting device, the seat and/or the wall via the connecting means.

As a result, the freedom of movement and/or the avoidance behavior of the crushing roller can be limited by the aforementioned fixation device and the damping device, preferably the damping means, can be securely fixed and connected in torsionally rigid manner (directly or indirectly) to the frame and/or the drive device.

In an alternative embodiment of the present invention, yet one which is also especially suitable in combination with the above-described damping device, it is provided that the drive device comprises a gearless motor. Thanks to this design, a very compact and hence also lightweight crushing apparatus is provided, which can also be easily transported on account of its compactness. The realization of a gearless motor of the drive device is especially advantageous in connection with the damping device, since a certain amount of design space would be required to realize a gearing and possibly the corresponding shafts or belts, which in turn would result in a larger seat for the damping device. Ultimately, the entire unit to be connected to the damping device would be increased by at least one further element, namely the gearing, which might also impair the damping function.

In conjunction with the gearless motor, it is especially advisable to use either a hydraulic motor or an electrical motor. Such motors can also be used to advantage for the purpose according to the invention, namely the use in the area of recycling and waste processing, when only relatively low rotary speeds are required for a high torque. When using a hydraulic motor, a radial piston motor having the mentioned attributes, namely a low rotary speed with a high torque, is especially suitable.

When using a hydraulic motor, the drive device is associated with a hydraulic pump device for the hydraulic motor, although this is not part of the damped subassembly.

Moreover, it is advisable to coordinate the drive device with a control device for speed control of the crushing roller, by which in particular the oil flow supplied by the hydraulic pump device is controlled. In this way, depending on the purpose of use and the feedstock, the required speed of the crushing roller for the crushing of the material to be crushed can be adjusted, especially in continuous manner.

Further features, benefits, and application possibilities of the present invention will emerge from the following specification of exemplary embodiments with the aid of the drawings and from the drawings themselves.

Figure 2:
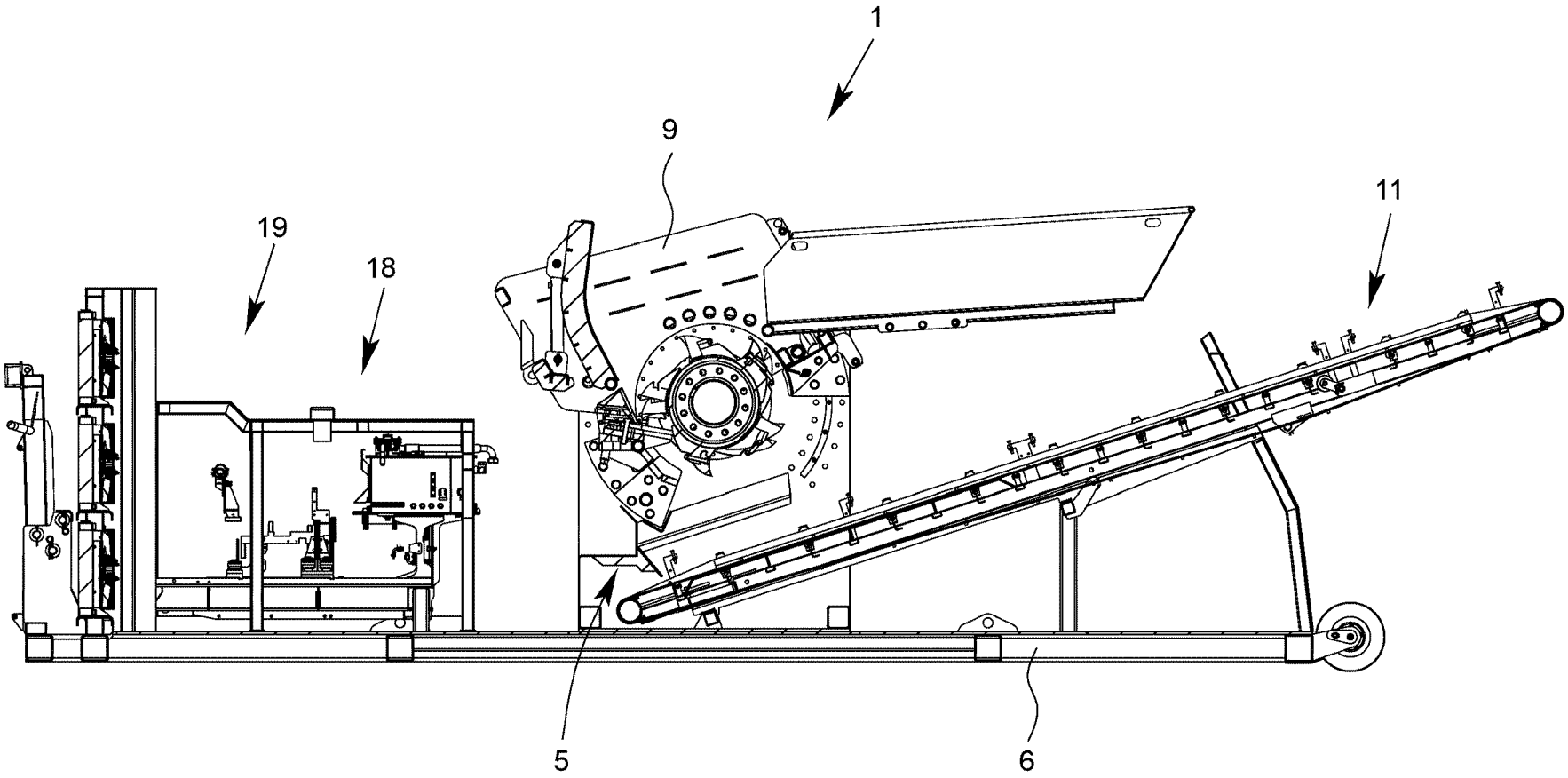
Figure 3:
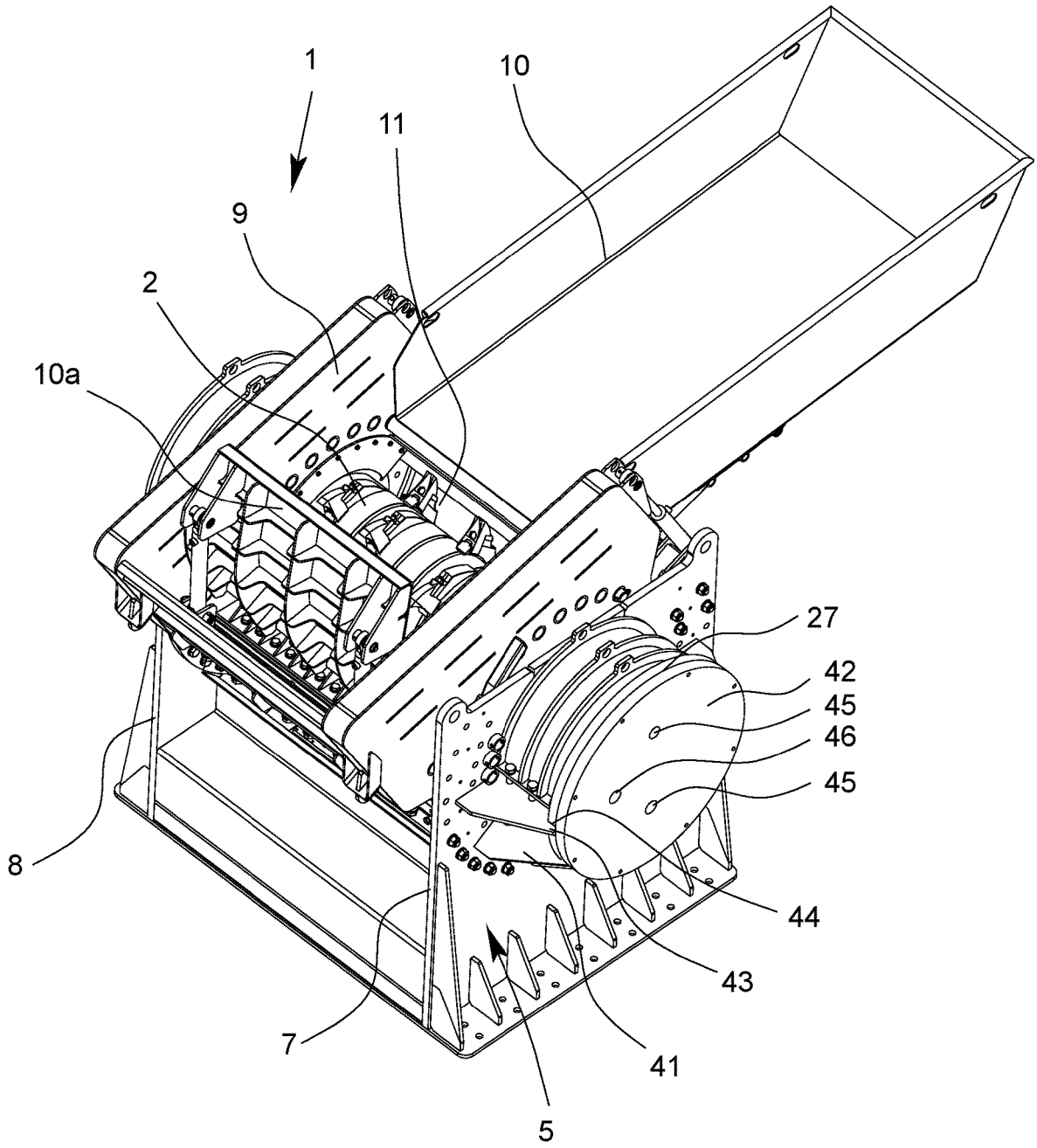
Figure 4:
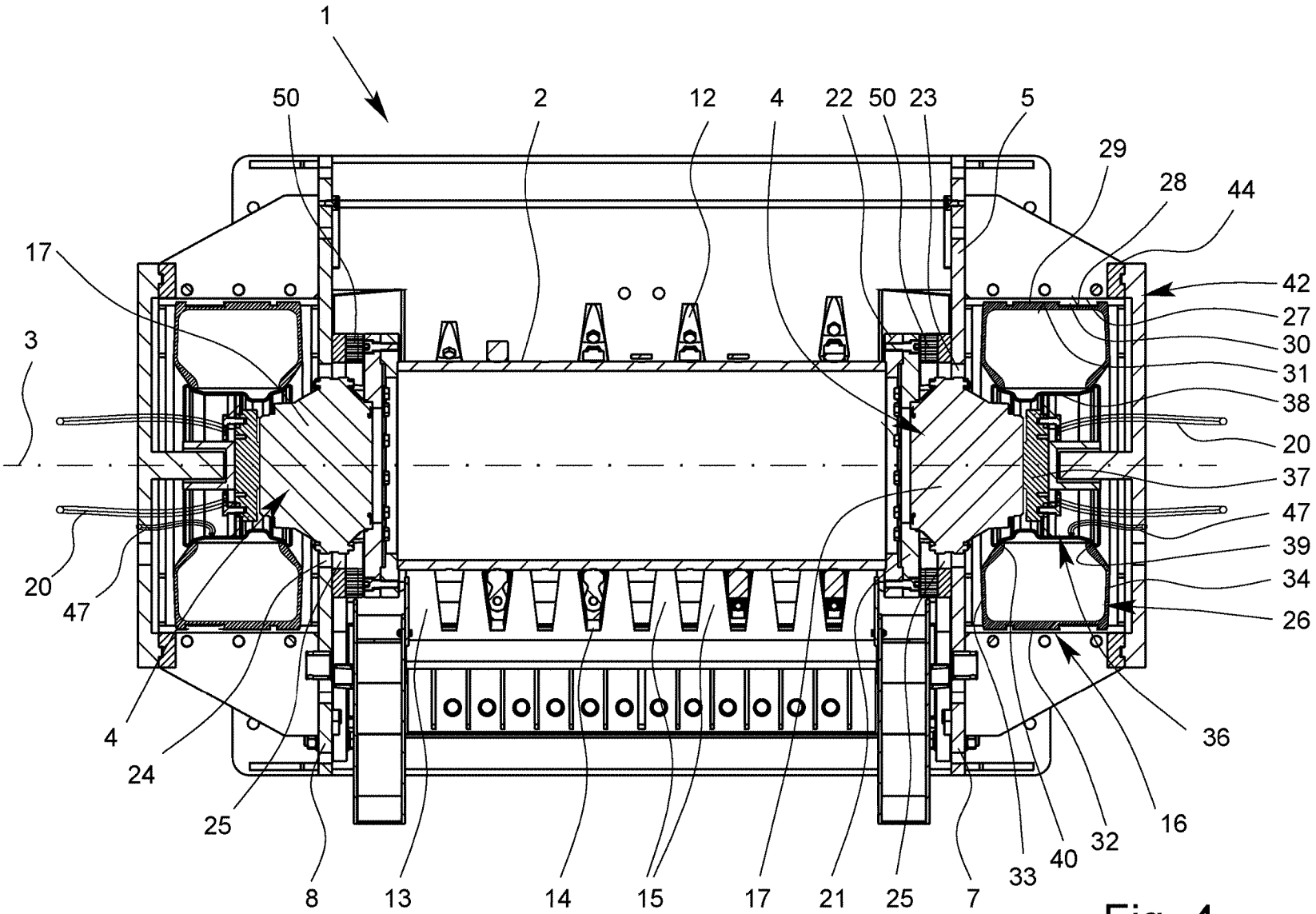
Figure 5:
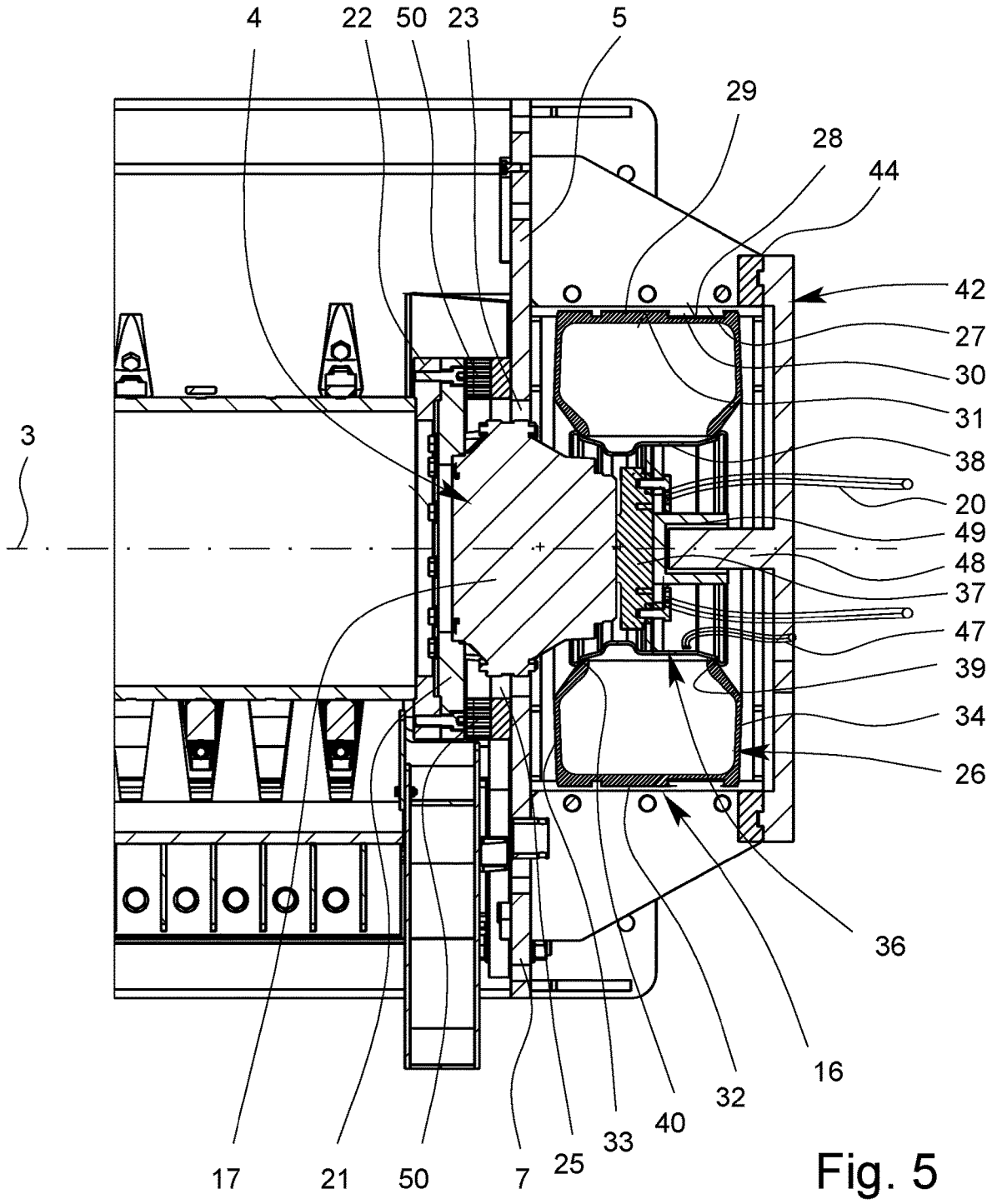
Figure 6:
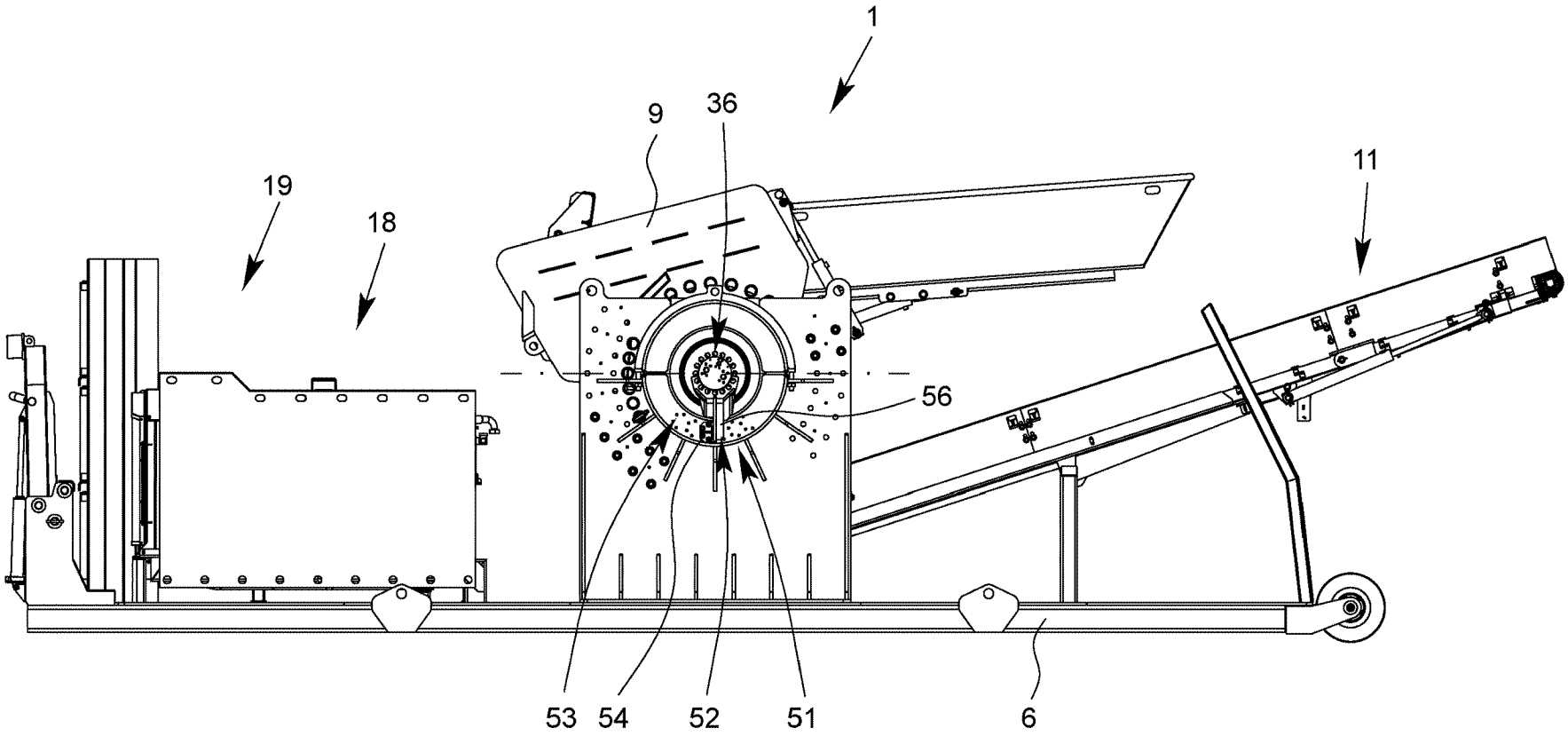
Figure 7:
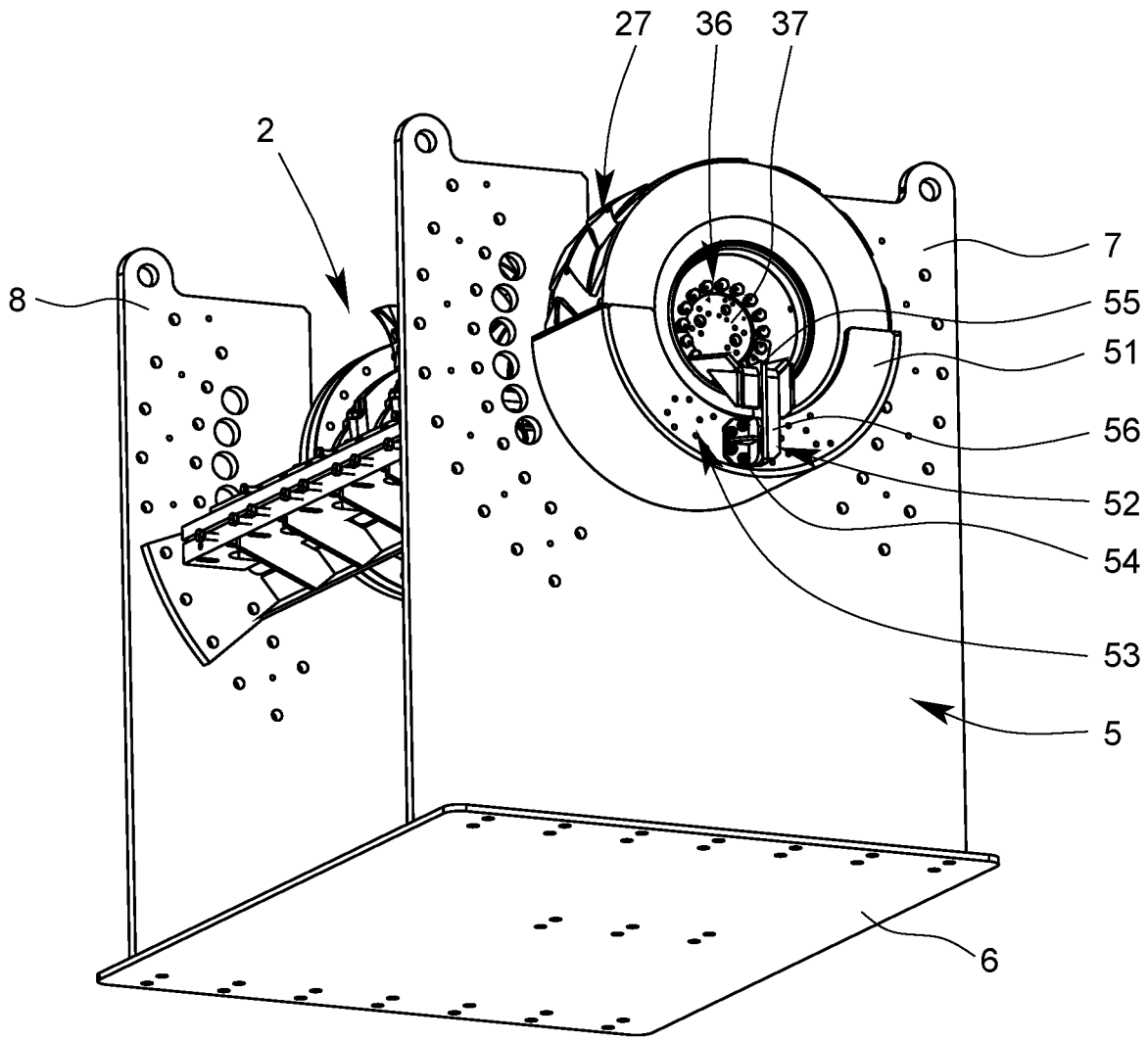
Figure 8:
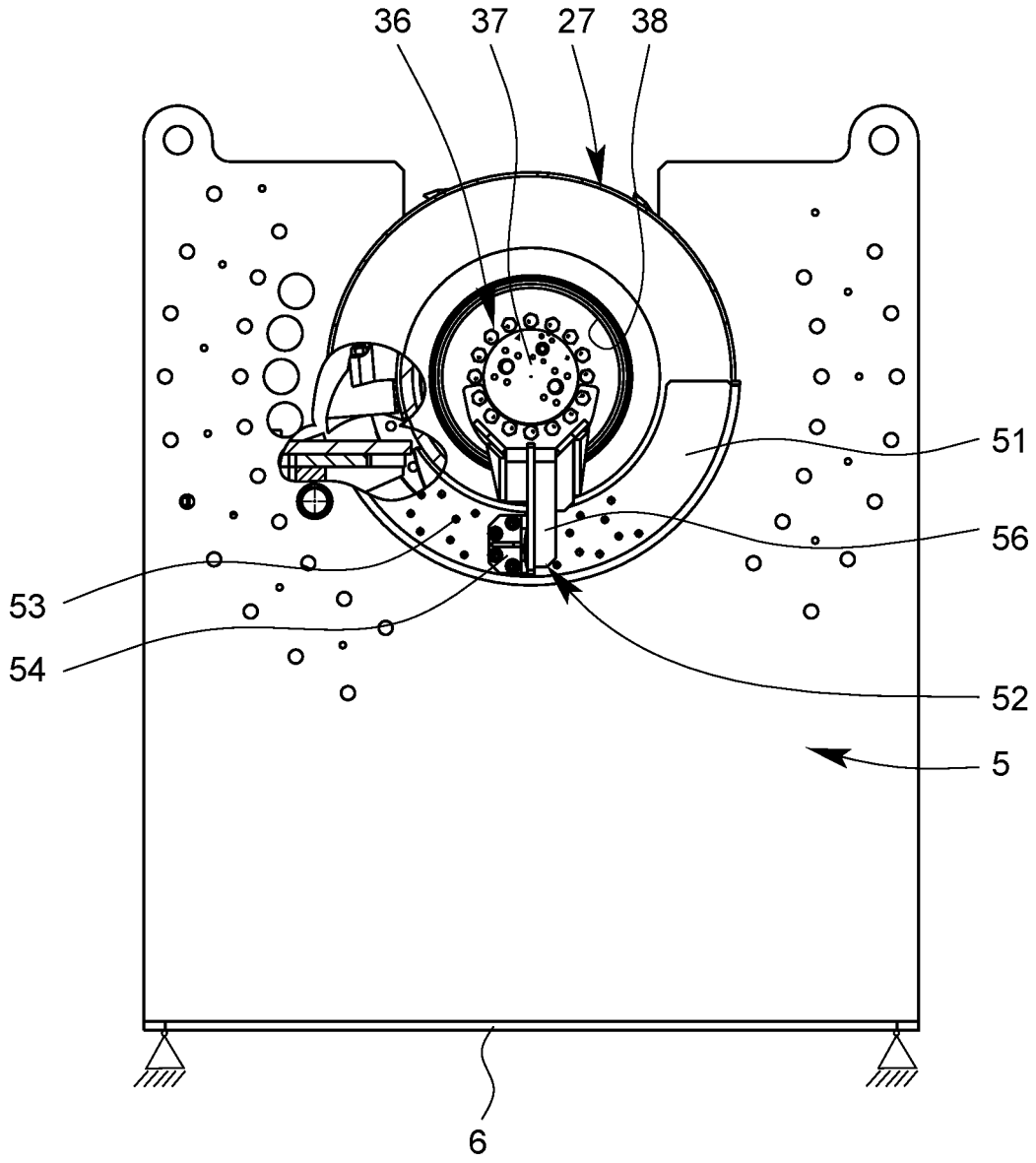
Figure 9:
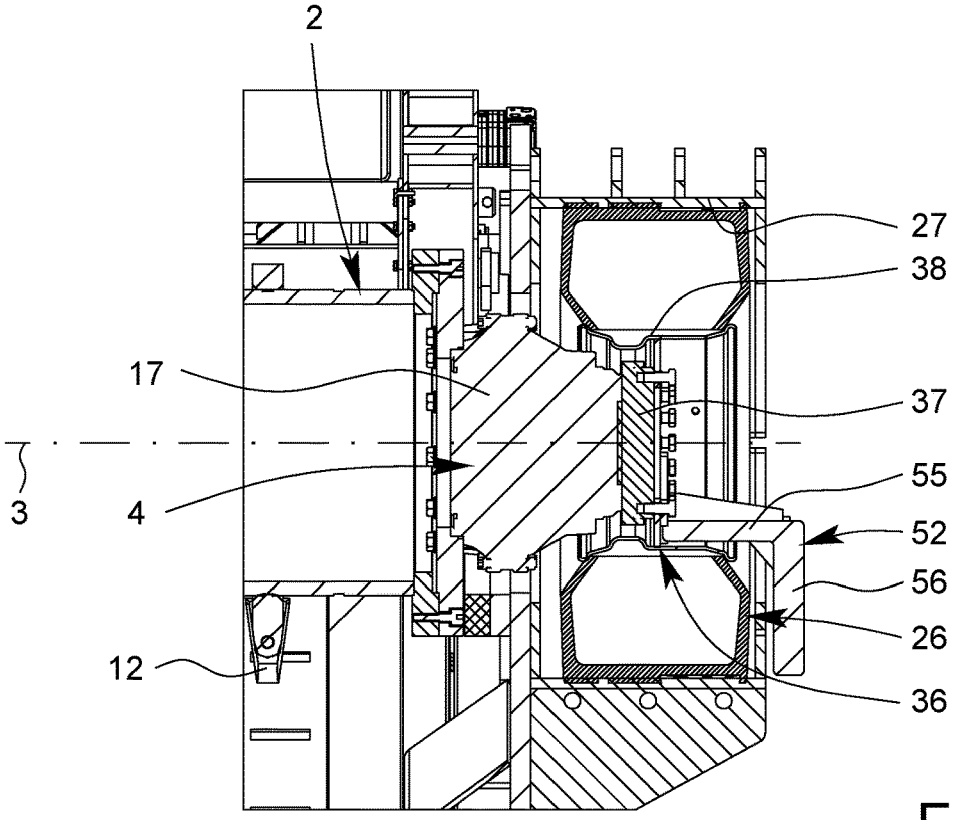
Figure 10:
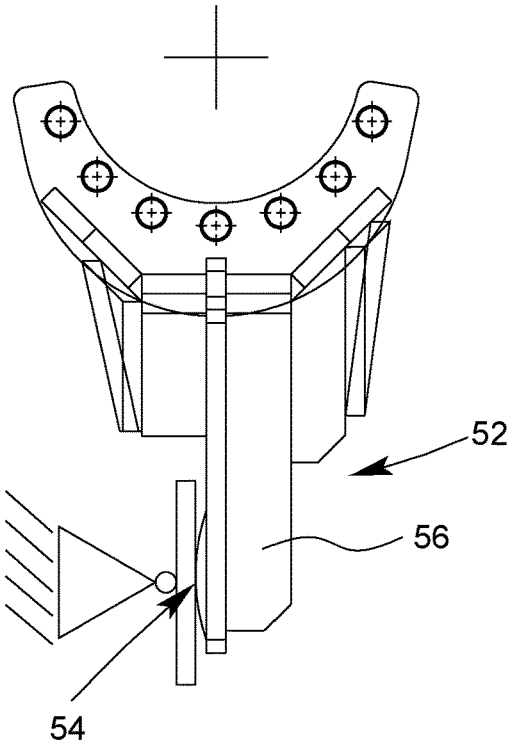
Figure 11:
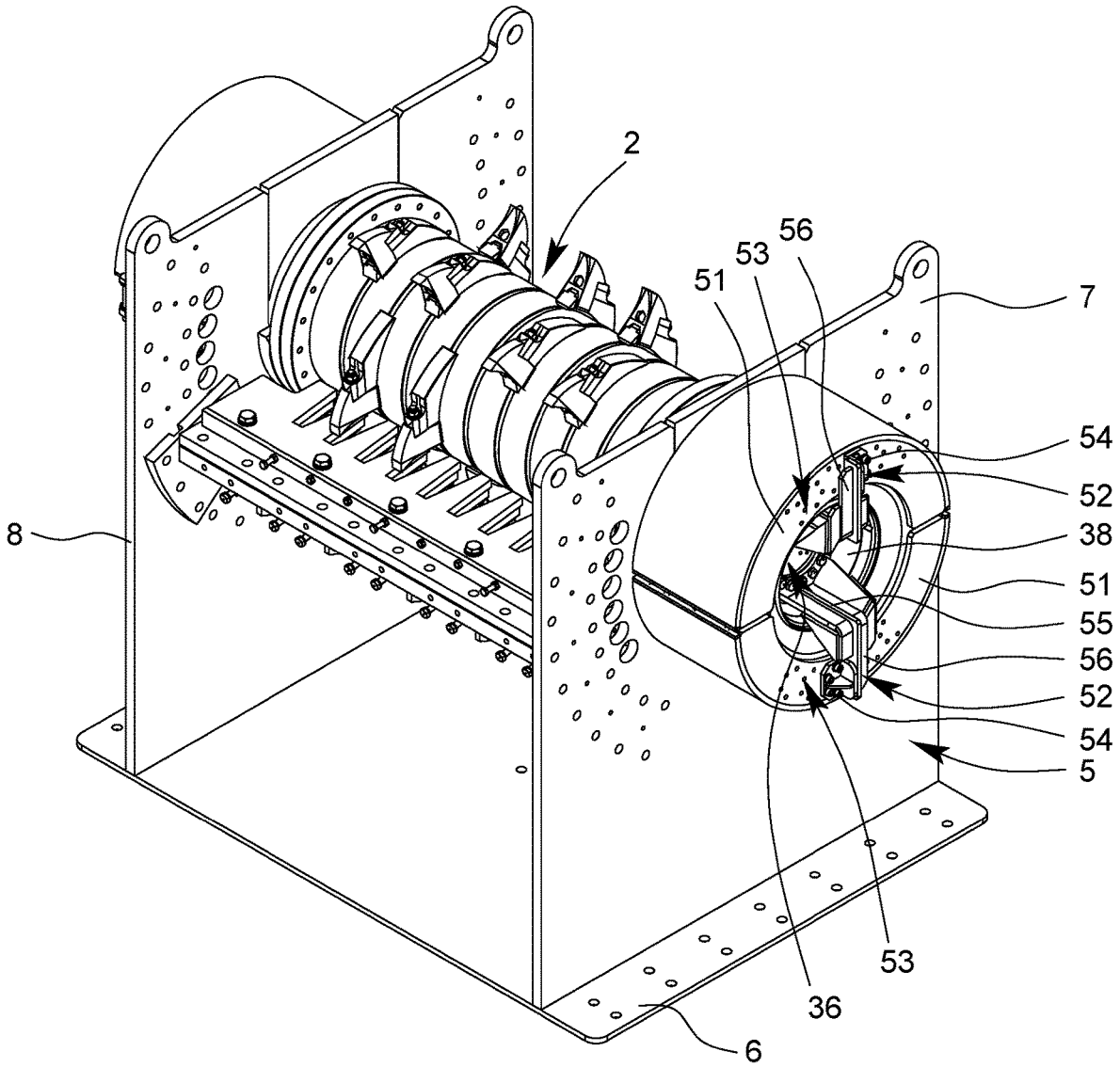
Figure 12:
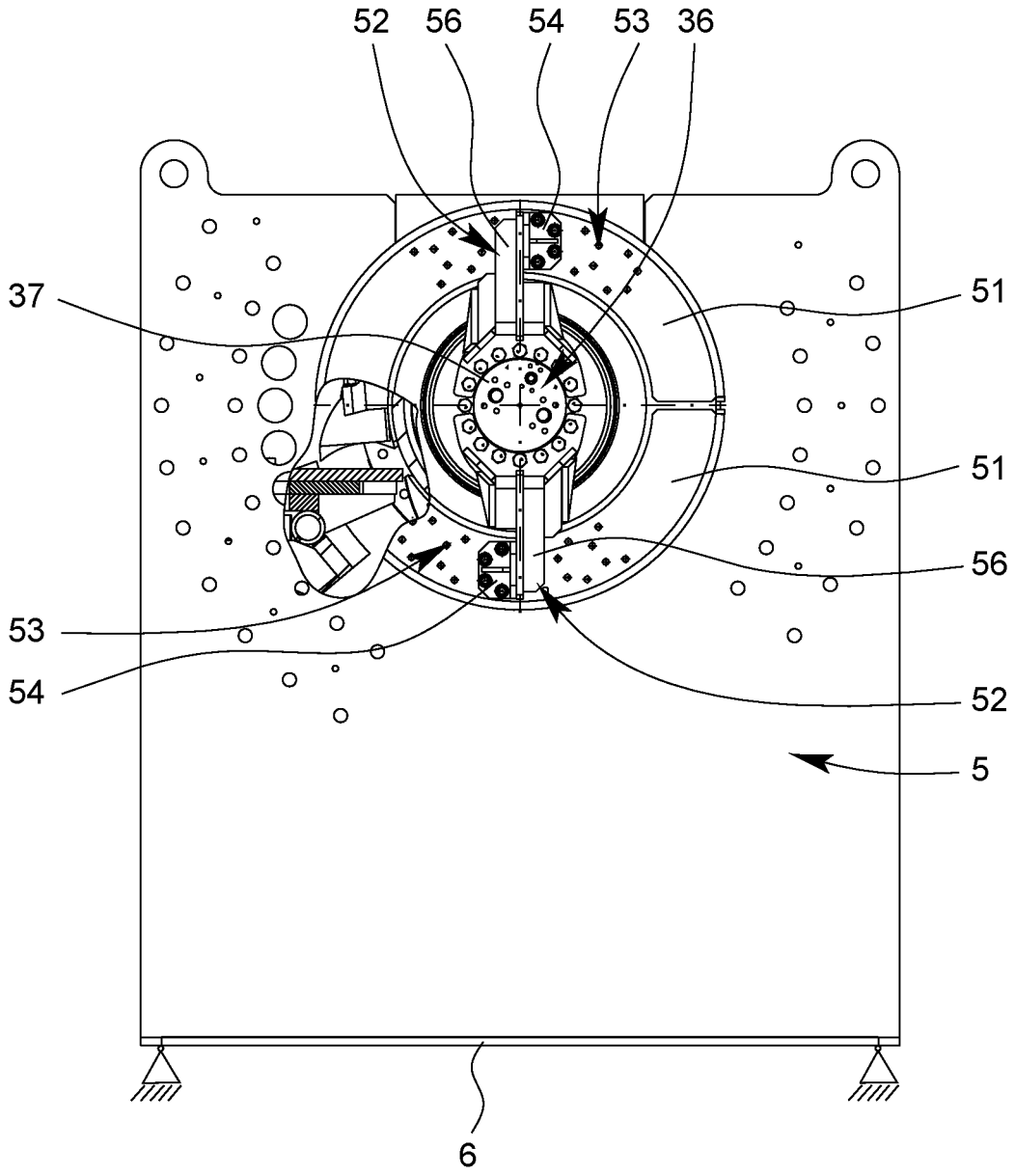

FIG. 1 shows a perspective view of a crushing apparatus according to the invention, FIG. 2 shows a lateral sectional view of the crushing apparatus of FIG. 1, FIG. 3 shows a perspective view of a crushing apparatus according to the invention omitting various modules and components, FIG. 4 shows a sectional view of the crushing apparatus of FIG. 1, FIG. 5 shows an enlarged representation of detail A of FIG. 4, FIG. 6 shows a schematic cross-sectional view of another embodiment of a crushing apparatus according to the invention, FIG. 7 shows a schematic perspective representation of another embodiment of a crushing apparatus according to the invention, FIG. 8 shows a schematic side view of the crushing apparatus according to the invention from FIG. 7, FIG. 9 shows a cross-sectional view of the crushing apparatus according to the invention from FIGS. 7 and 8, FIG. 10 shows a schematic cross sectional view of one part of another embodiment of the crushing apparatus according to the invention, FIG. 11 shows a schematic perspective representation of another embodiment of a crushing apparatus according to the invention and FIG. 12 shows a schematic side view of the crushing apparatus according to the invention from FIG. 11.

There is shown a crushing apparatus 1 for the crushing of material (not shown) to be crushed. The crushing apparatus 1 may be either a mobile or a stationary device. The crushing apparatus 1 may be used in the field of recycling or that of waste processing. Other uses or applications of the crushing apparatus 1 are readily possible. The material to be crushed may be, for example, refuse of varying compositions and/or fractions. The crushing apparatus 1 in the exemplary embodiment shown comprises a crushing roller 2, which can rotate about a horizontal axis of rotation 3 in the exemplary embodiments shown or which rotates about the axis of rotation 3.

It should be pointed out that the crushing apparatus 1 is not limited to the use of only one crushing roller 2. Basically, the crushing apparatus 1 may also have at least two crushing rollers arranged next to each other with parallel running axes of rotation and between which a roller gap is provided. The following remarks, which pertain to the use of only one crushing roller 2, may be applied accordingly to a crushing apparatus with at least two crushing rollers.

In the embodiment represented with only one crushing roller 2, the crushing apparatus 1 comprises a drive device 4 in the area of each end of the crushing roller 2 for the driving of the crushing roller 2. Furthermore, a frame 5 is provided, serving for the supporting and mounting of the crushing roller 2 and the drive devices 4. The frame 5 is connected to a base plate 6, which may basically also have the shape of a frame. The actual housing-like frame 5 is placed on the base plate 6 and has side walls 7, 8 between which the crushing roller 2 is arranged. Between the side walls 7, 8 there is a hopper 9, into which a chute 10 empties. The feedstock is supplied above the chute 10, drops into the hopper 9, and is taken to the crushing roller 2. Moreover, a tilt-adjustable plate 10*a* is located in the hopper 9 on the side opposite the chute 10. The inclination of the plate 10*a* is adjusted according to the feedstock.

Furthermore, the crushing apparatus 1 in the embodiments represented in FIGS. 1 and 2 comprises a conveyor 11, being in the present instance a belt conveyor. The conveyor 11 is adjustable by a tilting device. The feeding end of the conveyor 11 is located in the lower region of the frame 5 beneath the crushing roller 2, while the discharge end is led away from the frame 5 and protrudes lengthwise beyond the base plate 6.

The embodiment shown in FIG. 3 lacks not only the base plate 6, but also the conveyor 11. Basically, it is possible for the frame 5 to be mounted on the subfloor, with a shaft able to be provided in the subfloor to take away the crushed material.

Moreover, there are arranged on the crushing roller 2, distributed around its external circumference, a plurality of crushing tools 12, while a counter-comb 13 is provided in the frame 5 beneath the hopper 9. The crushing tools 12 mesh with the counter-comb 13, which provides corresponding slots 14 for the individual crushing tools 12. Between the slots 14, there are located counter-comb teeth 15. If a crushing tool 12 is situated in a slot 14 of the counter-comb 13, a distance between 2 mm and 10 mm is still provided between the respective crushing tool 12 and the adjacent counter-comb teeth 15.

It is now provided in the crushing apparatus 1 that the crushing roller 2 and the end or face-side drive devices 4 are connected as a common assembly to a respective damping device 16, which in the present instance is mounted by friction-locking and elastically in or on the frame 5.

In the embodiment shown, moreover, each of the drive devices 4 has a gearless motor 17, so that an overall very compact and small-sized design of the crushing apparatus 1 results, as is especially evident from FIGS. 4 and 5. The motor 17 in the present instance is a hydraulic motor in the form of a radial piston motor. The motor 17, as is especially visible from FIGS. 1 and 2, is coordinated with a hydraulic pump device 18, which in the present instance is driven by a Diesel motor 19. The hydraulic pump device 18 is connected by hydraulic hoses 20 to the motor 17.

What is not shown is that the drive device or the motor 17 is coordinated with a control device for controlling the speed of the motor 17 and thus that of the crushing roller 2, wherein the control ultimately occurs by controlling the oil flow through the hydraulic pump device 18.

As follows especially from FIGS. 3 and 4, the motors 17 are firmly connected to the crushing roller 2 and form a common assembly in the layout of motor—crushing roller—motor. For this, a respective attachment flange 21 is secured to, in the present case screwed onto, the output end of the motors 17. Basically, it is also possible for the motor housing to already have a corresponding attachment flange. The attachment flange 21 in turn is screwed together with the crushing roller 2, in the present case by an edge flange 22 of the crushing roller 2. The attachment flange 21 ultimately serves as an adapter to adapt the comparatively small motor 17 to the comparatively larger crushing roller 2. The fastening of the motors 17 does not differ on the two sides of the crushing roller 2. Thus, both motors 17 are fastened in the same way to the end face of the crushing roller 2.

The structural unit formed by the crushing roller 2 and the motors 17, whose individual components are connected to each other in a torque-proof manner, protrudes in the area of the motors 17 through the two side walls 7, 8 of the frame 5. For this, corresponding openings 23, 24 are provided in the side walls 7, 8 respectively. A respective annular gap 25 is located between the outside of the motors 17 and the openings 23, 24. During the operation of the crushing apparatus 1 and/or the rotation of the crushing roller 2, the housings of the motors 17 have no contact with the side walls 7, 8. Deflection movements executed by the assembly as needed are therefore possible without any contact of the motors 17 with the side walls 7, 8.

The crushing roller 2, including the end-face motors 17 connected to it in a torque-proof manner, is mounted in a damped manner on both sides, namely, by a damping device 16 provided on each side. The damping device 16 is configured on both sides in such a way that a movement of the crushing roller 2 is possible in the axial direction, i.e. in the direction of the axis of rotation 3, and in the radial direction, i.e. transversely to the axis of rotation 3.

Each of the damping devices 16 comprises a flexible damping means 26 in the shape of a circular ring, arranged in a corresponding circular seat 27 by frictional or form fitting manner in the present case, but in any case with torsional rigidity. This shall be discussed further below. The seat 27 is part of the frame 5 or firmly secured to the frame 5.

The damping means 26 in the present instance consists at least substantially of a natural rubber material, especially on its peripheral outer side, and comprises indentations 28 and protrusions 29. On the inner side of the seat 27 facing toward the damping means 26, the seat has protrusions 30 for engaging with the indentations 28 and indentations 31 for engaging with the protrusions 29, so that a form closure results from the corresponding indentations 28, 31 and protrusions 29, 30. Moreover, the seat 27 consists of metal, especially steel, so that a relatively large coefficient of friction results from the material pairing of the rubber of the damping means 26 and the steel surface. In order to achieve a coefficient of friction greater than 0.5 and especially greater than 0.6, one of the surfaces, i.e., either that of the damping means 26 and/or that of the seat 27, can be provided with a corresponding coating with increased coefficient of friction, although this is not illustrated. On the whole, however, the damping means 26 consists of an elastic material. Thus, the damping means 26 may have natural rubber as the base material, possibly with reinforcing material which is contained in the damping means 26.

The damping means 26 is a fillable hollow body, with pressurized air intended for the filling of the hollow body in the present case. A different pressure medium can also be used, however. In the embodiment shown, the damping means 26 is designed as a kind of wheel tire, having an outer bearing surface 32, to which side cheeks 33, 34 are attached at the sides. At the inside, the damping means 26 is open, yielding a U shape in cross section. This shall be further discussed below.

The mentioned configuration of the damping means 26 as a kind of wheel tire makes it possible to fill the damping means 26 with pressurized air even during the operation of the crushing apparatus 1, in order to increase the pressing force and thus the rigidity of the damping means 26, or to decrease it as needed. For the correct pressure setting and thus also the pressure corresponding to the rigidity setting, a measuring device is provided for measuring the pressure in the damping means 26. The measuring device comprises a sensor, not shown, which communicates with the inner space of the hollow damping means 26. If need be, the sensor may protrude into the inner space of the damping means. What is not shown is that the measuring device is coupled to a control device, which in turn is coupled to a signal device for emitting an optical and/or acoustical signal, a disconnection device for the drive devices 4, and/or a filling device for the filling and/or emptying of the damping means 26.

The connection of the damping means 26 to the assembly produced from the two drive devices 4 and the rotationally secured crushing roller 2 is accomplished by a connection means 36. The connection means 36 is a rim-like body with an inner flange plate 37, which serves for the fastening/flanging of the outside of the motor 17. Furthermore, the connection means 36 has an exterior hollow cylindrical fastening area 38, which is joined toward the inside to the flange plate 37 and which is fashioned on its outside for connection to the damping means 26. For this, the fastening area 38 has a respective circumferential protrusion 39, 40 at its edge, against which the inner edges of the side cheeks 33, 34 rest on the inside and at the same time provide a seal in this location when the damping means 26 is filled with the pressure medium.

Since the forces which occur during the operation of the crushing apparatus 1 and which act on the crushing tools 12 act through the respective drive device 4 on the damping means 26 and these forces are then transmitted to the respective seat 27, reinforcing cheeks 41 are provided on the outside to strength the seat 27, being fastened on the one hand to the seat 27 and on the other hand to the respective side wall 7, 8. This is evident in particular from FIG. 1.

On the outside, the seat 27 is closed by a supporting plate 42, which is mounted on the seat 27. For the correct placement and fixation of the supporting plate 42, recesses 43 are provided on the supporting plate 42, engaging with associated reinforcing cheeks 41 by their end 44. Basically, of course, it is also possible to provide protrusions on the supporting plate 42, engaging with corresponding openings or recesses in the area of the seat 27. The supporting plate 42, moreover, has duct openings 45, 46 for the passage of the hydraulic hoses 20 for the motor 17 and a pressurized line 47, which is connected to a filling device for the damping means. In particular, this may be a pneumatic device for pressurized air supply of the damping device 16.

On the inside of the supporting plate 42 there is located a cylindrical end stop element 48. Moreover, a hollow cylindrical or cup-shaped section 49 is fastened centrally to the flange plate 37. The center axis of the section 49 is located on the axis of rotation 3. The same holds for the arrangement of the end stop element 48, whose center axis is likewise located on the axis of rotation 3. The end stop element 48 protrudes into the section 49, with a free space remaining both at the end face and in the radial direction, each being smaller than the free spaces in the slots 14 between the crushing tools 12 and the counter-comb teeth 15. This ensures that the movement of the subassembly in the axial or radial direction does not result in the crushing tools 12 engaging with the counter-comb teeth 15.

In addition or alternatively to the previously-described end stop means with the end stop element 48 and the section 49, an end stop protrusion 50 may be provided on the inside of one or both side walls 7, 8, pointing in the direction toward the attachment flange 21. The free space remaining between the end stop protrusion 50 and the attachment flange 21 is once again smaller than the free spaces in the slots 14 between the counter-comb 13 and the crushing tools 12 when the latter are moved through the counter-comb 13.

During the operation of the crushing apparatus 1, the crushing roller 2 rotates with a given rotational velocity for a given rotary speed, which can be adjusted as needed via the motors 17. The material to be crushed, placed on the chute 10 and dropping into the hopper 9, is crushed by the crushing tools 12 in the area of the counter-comb 13. If the material to be crushed is very hard and cannot be crushed immediately, the damping device 16 makes it possible for the structural unit consisting of the crushing roller 2 and the motors 17 to perform a deflection movement in the axial and/or radial direction in regard to the axis of rotation 3, up to the maximum point that the respective end stop means becomes active. In regard to the end stop element 48 and the section 49, a movement is possible until the mutually facing end surfaces of the end stop element 48 and the section 49—with regard to the axial direction—touch each other, while in the radial direction an end stop will occur when the outside of the end stop element 48 bears against the inside of the section 49. Thanks to this limitation of the movement, the movement of the crushing tools 12 through the slots 14 of the counter-comb is not restricted. The load peaks which occur are dampened by the damping devices 16, that is, specifically by the respective damping means 26, and are conducted via the seat into the side walls 7, 8, insofar as the resulting energy is not converted into thermal energy in the area of the damping means 26.

One must make sure that the damping means 26 is arranged torsionally rigid in the seat 27. In particular, one must make sure that the rigidity of the damping means 26 is chosen such that the protrusions 29, 30 and the indentations 28, 31 always engage with each other. The damping means 26 can then damp the resulting movements of the subassembly by virtue of the elasticity of the material of the damping means 26 or its rigidity.

FIG. 6 shows a fixation device 52 which is firmly connected to the flange plate 37 and the connection means 36. In further embodiments, the fixation device 52 can be connected to the fastening area 38. Moreover, the fixation device 52 secures the connection means 36, the damping means 26 and the damping device 16 on the seat 27 and accordingly indirectly on the frame 5, so that the damping device 16, the damping means 26 and the connection means 36 are connected torsionally rigidly to the frame 5. A direct fastening of the fixation device 52 to the frame 5 is also possible in principle.

The fixation device 52 is designed such that a torsionally rigid connection of the damping means 26 to the drive device 4 can be assured even under very large stresses.

FIG. 9 shows that the fixation device 52 in the depicted embodiment comprises a fastening section 55 and an operating section 56. From the cross-sectional representation shown in FIG. 9, it is seen that the fixation device 52 has an angle-shaped cross section. The fastening section 55 in the depicted exemplary embodiment is firmly connected to the connection means 36. The operating section 56 is arranged at least indirectly on the frame 5. FIG. 7 shows that the operating section 56 interacts with the seat 27. Furthermore, FIG. 7 shows that the operating section 56 is mounted and secured with the supporting device 51, which is firmly connected to the frame 5. In other embodiments, the supporting device 51 may be configured as part of the seat 27 and/or be fastened to the frame 5 independently of the seat 27.

In one embodiment (not shown), the operating section 56 of the fixation device 52 interacts directly or indirectly with the bearing wall 7, 8 of the frame 5.

FIG. 8 shows that the supporting device 51 surrounds the lower half, which faces toward the base plate 6, of the damping means 26 or the seat 27. Instead of a supporting plate 42, the damping means 26 or the connection means 36 is enclosed at least in sections by the supporting device 51.

A plurality of openings 53 are provided on the supporting device 51, or in other embodiments on the seat 27. The openings 53 serve for the mounting or fastening of the fixation device 52 and are accordingly designed to engage with screws.

Furthermore, the fixation device 52 in the depicted exemplary embodiment comprises a connecting means 54, or a connecting means 54 is associated with the fixation device 52. The connecting means 54 likewise has openings corresponding to the openings 53 of the supporting device 51 and serves for the mounting of screws and for the fixation of the operating section 56 of the fixation device 52.

A perspective view of the fixation device 52 is shown in FIG. 7. It is furthermore evident from FIG. 7 that the fixation device 52 can be situated at various positions on the seat 27 or on the supporting device 51. In the exemplary embodiment shown, the fixation device 52 or the operating section 56 is situated at least substantially transversely or at a 90° angle to the cutting action of crushing tool 12 to counter-comb tooth 15. The specified angle pertains to a vertex point with regard to the axis of rotation 3 of the crushing roller 2.

FIG. 8 shows that, starting from this 90° position, the operating section 56 of the fixation device 52 can be adjusted in a range of +/−45° relative to the 90° position which is shown in the depicted exemplary embodiments. Basically, the arrangement of the fixation device 52 or the operating section 56 in other embodiments that are not shown may vary in an angle range of 0° to 360°, with the 90° position being shown in the embodiments represented in FIGS. 6 to 9.

Furthermore, in the embodiments per FIGS. 6 to 10, it is provided that the fixation device 52 is situated only in the lower half of the seat 27 or of the connection means 36. Ultimately, the fixation device 52 can be situated in any region of the seat 27 or the connection means 36.

FIG. 10 shows another embodiment of the fixation device 52, where a spherical contact surface is provided as the connecting means 54 and/or on the operating section 56. The fixation device 52—in the embodiment shown in FIG. 10—also serves as the torque bracket of the damping means 26. In this case, the connecting means 54 acts as an end stop, whereby the formation of the contact surface is not important.

The fixation device 52 can ultimately be viewed as a backstop. The backstop or the fixation device 52, ultimately having the function of a claw or a clamping claw, is arranged firmly on the frame 5 and joined with torsional rigidity to the frame 5. The torsionally rigid connection of the fixation device 52 to the frame 5 is achieved by the torsionally rigid connection of the fastening section 55 to the connection means 36 and the interaction between the operating section 56 and the bearing wall 7, 8 of the frame 5.

Furthermore, it is evident from FIGS. 10 and 11 that two fixation devices 52 are arranged on the seat 27. In the specific exemplary embodiment, the first, lower fixation device 52 is arranged in a 90° position with respect to the cutting action, while the fixation devices 52 make an angle of at least substantially 180° with each other and thus lie opposite each other.

Furthermore, FIGS. 10 and 11 show that two supporting devices 51 are arranged on the frame 5 and/or the bearing wall 7, 8 and/or firmly joined to the frame 5. The operating sections 56 of the fixation devices 52 in the depicted exemplary embodiment are mounted on the supporting devices 51—in the specific exemplary embodiment joined with torsional rigidity to the supporting devices 51. The supporting devices 51 may be regarded as part of the seat 27 or in other embodiments as separate components.

In the embodiment shown, the second, upper fixation device 52 is at least substantially identical in design to the first, lower fixation device 52. Furthermore, the first, lower fixation device 52 is at least substantially identical in design to the previously-described embodiment, which can be seen in FIGS. 6 to 9. Consequently, therefore, one may omit any further remarks in order to avoid repetition.

Furthermore, FIG. 12 shows that both fixation devices 52 can be adjusted by arranging the connecting means 54 at other openings 53 of the respective supporting device 51 and connecting it by screws in positive-locking and/or force-locking manner to the supporting device 51.

The fixation devices 52 can make an angle between 80° and 180°, in other embodiments between 140° and 180°, with each other. The mounting of the second fixation device 52 may even be changed by +/−100°, as shown in FIGS. 11 and 12.

In embodiments that are not shown, a plurality of fixation devices 52 could be connected to the connection means 36 and mounted at least indirectly on the bearing wall 7, 8.

LIST OF REFERENCE NUMBERS

1 Crushing apparatus
2 Crushing roller
3 Axis of rotation
4 Drive device
5 Frame
6 Base plate
7 Side wall
8 Side wall
9 Hopper
10 Chute
10*a* Plate
11 Conveyor
12 Crushing tool
13 Counter-comb
14 Slot
15 Counter-comb tooth
16 Damping device
17 Motor
18 Hydraulic pump device
19 Diesel motor
20 Hydraulic hose
21 Attachment flange
22 Edge flange
23 Opening
24 Opening
25 Annular gap
26 Damping means
27 Seat
28 Indentation
29 Protrusion
30 Protrusion
31 Indentation
32 Bearing surface
33 Side cheek
34 Side cheek
36 Connection means
37 Flange plate
38 Fastening area
39 Protrusion
40 Protrusion
41 Reinforcing cheek
42 Supporting plate
43 Recess
44 End
45 Duct opening
46 Duct opening
47 Pressurized line
48 End stop element
49 Section
50 End stop protrusion
51 Supporting device
52 Fixation device
53 Openings of the supporting device
54 Connecting means
55 Fastening section
56 Operating section

The invention claimed is:

1. A crushing apparatus configured to crush a material including at least one crushing roller that can rotate about an axis of rotation, at least one motor adapted to drive the crushing roller, and a frame to hold and support the crushing roller and the motor, wherein the crushing roller and the motor are supported by at least one damping device, the at least one damping device at least partially circumferentially surrounds the motor, the at least one damping device is mounted in or on the frame, the damping device is configured for movement of the crushing roller in one or more of an axial direction and in a radial direction of the axis of rotation, and the damping device includes a flexible damper arranged in a corresponding receptable of the frame.

2. The crushing apparatus according to claim 1, wherein the crushing roller is dampened on both sides.

3. The crushing apparatus according to claim 1, wherein the damper is circular.

4. The crushing apparatus according to claim 1, wherein the damping device comprises one or more of on its outer side and the receptacle comprises on its inner side facing toward the damper, a surface with an increased coefficient of friction greater than 0.4.

5. The crushing apparatus according to one claim 1, wherein the damper has a positive-locking connection to the receptacle, and the damper comprises on its outer side one or more of indentations and protrusions for engagement with corresponding indentations and/or protrusions on the inner side of the receptacle facing toward the damper.

6. The crushing apparatus according to claim 1, wherein the rigidity of the damper is automatically adjustable.

7. The crushing apparatus according to claim 1, wherein the damper is a hollow body which can be filled with a medium.

8. The crushing apparatus according to claim 7, wherein a measuring device is provided for measuring a pressure of the medium which is coupled to a control device, and the control device is coupled to one or more of a signal device, a disconnection device of the motor, and a filling device configured to fill or empty the hollow body.

9. The crushing apparatus according to claim 1, wherein a connector is provided for the connection of the damper to the motor, wherein the connector comprises a flange plate for a torsionally rigid connection to the motor and a hollow cylindrical fastening area connected to the flange plate for the connection to the damper.

10. The crushing apparatus according to claim 9, wherein at least one fixation device is connected to one or more of the connector, the fastening area, and the flange plate in locking, torsionally rigid, manner, for the securing of at least the damping device.

11. The crushing apparatus according to claim 1, wherein to limit the axial and/or radial deflection movement of the crushing roller at least one end stop is provided.

12. The crushing apparatus according to claim 11, wherein the end stop comprises a cylindrical end stop element and a corresponding hollow cylindrical or cup-shaped section for the engagement of the end stop element, wherein the end stop element is fastened on the inside to a supporting plate which is secured to the frame.

13. The crushing apparatus of claim 1, wherein the at least one motor comprises a gearless motor.

14. The crushing apparatus according to claim 13, wherein the gearless motor is a hydraulic motor, a radial piston motor, or an electric motor.

15. The crushing apparatus according to claim 14, wherein the motor is associated with a hydraulic pump device for the hydraulic motor, wherein the motor is associated with a control device for the rotary speed setting of the crushing roller by controlling the oil flow supplied via the hydraulic pump device.

16. A crushing apparatus comprising:

a crushing roller configured to rotate about an axis of rotation;

at least one motor adapted to support and drive the crushing roller;

a frame to hold and support the crushing roller and the at least one motor; and a damping device to isolate and decouple the at least one crushing roller and the at least one motor from the frame, wherein:

the at least one motor is supported in the frame by the damping device, the damping device at least partially circumferentially surrounds the at least one motor, the damping device is mounted to the frame, the damping device is configured to allow movement of the crushing roller and the at least one motor in one or more of an axial direction and in a radial direction relative to the axis of rotation, and the damping device includes a flexible damper.

17. The apparatus of claim 16, wherein the flexible damper is a ring or is circular.

18. The apparatus of claim 17, wherein the ring is attached to a seat of the frame.

19. The apparatus of claim 16, wherein a rigidity of the flexible damper is adjustable.

* * * * *